US005704184A

United States Patent [19]

Meloy

[11] Patent Number: 5,704,184

[45] Date of Patent: Jan. 6, 1998

[54] IMPACT PAD FOR LADLES

[75] Inventor: Walter D. Meloy, Pittsburgh, Pa.

[73] Assignee: Indresco Inc., Dallas, Tex.

[21] Appl. No.: 387,529

[22] Filed: Feb. 13, 1995

[51] Int. Cl.[6] ..... B22D 41/02; C21C 5/44

[52] U.S. Cl. ..... 52/608; 52/245; 52/604; 110/338; 126/151; 264/30; 266/283; 432/248

[58] Field of Search ..... 52/89, 245, 604, 52/608; D25/113; 110/336, 338; 264/30; 266/280, 281, 282, 283, 284; 432/119, 248; 126/151

[56] References Cited

U.S. PATENT DOCUMENTS

| | | | |
|---|---|---|---|
| 72,734 | 12/1867 | Hennessey | 52/245 |
| 300,521 | 6/1884 | Smith | 52/605 X |
| 850,048 | 4/1907 | Playford . | |
| 1,367,511 | 2/1921 | Cathroe | 52/245 |
| 1,403,177 | 1/1922 | Mack | 52/89 |
| 1,586,194 | 5/1926 | Gustavsen | 52/575 |
| 1,655,566 | 1/1928 | Reintjes | 432/119 |
| 1,845,472 | 2/1932 | Albright | 52/591.1 |
| 2,155,026 | 4/1939 | Tracy | 122/156 |
| 2,258,518 | 10/1941 | Scovron | 432/119 X |
| 2,818,248 | 12/1957 | Kelsey . | |
| 2,877,506 | 3/1959 | Almoslino | D25/113 X |
| 2,888,779 | 6/1959 | Hostetter | 47/33 |
| 3,140,333 | 7/1964 | Tredennick et al. . | |
| 3,346,248 | 10/1967 | Martinet et al. . | |
| 3,635,459 | 1/1972 | Mare | 266/283 |
| 5,428,934 | 7/1995 | Tomek | 52/608 |

FOREIGN PATENT DOCUMENTS

| | | | |
|---|---|---|---|
| 517157 | 10/1955 | Canada . | |
| 454653 | 10/1991 | European Pat. Off. | 266/280 |
| 3224496 | 1/1983 | Germany . | |
| 590972 | 4/1959 | Italy | 432/119 |
| 2-175067 | 7/1990 | Japan | 266/283 |
| 2270906 | 11/1990 | Japan . | |
| 7508786 | 1/1977 | Netherlands . | |
| 12833 | 6/1902 | United Kingdom | 52/89 |
| 13257 | 6/1902 | United Kingdom | 52/608 |
| 293331 | 6/1928 | United Kingdom | 432/119 |

*Primary Examiner*—Carl D. Friedman
*Assistant Examiner*—Laura A. Saladino
*Attorney, Agent, or Firm*—John L. Sigalos

[57] ABSTRACT

A refractory brick that has a rear portion with a geometrical concavity on one side and a corresponding convex projection on the other side, the concavity and projection being matched so that the concavity mates with the corresponding projection of a similar refractory brick when the two are disposed in side-by-side relationship. Extending perpendicular from the base portion is a generally rectangular projection such that when a plurality of bricks are disposed in a side-by-side array, they are locked together by the mating concavities and projections, and the generally rectangular projections extend inwardly to form a thicker lining to withstand the force of a tap stream of molten metal for a longer duration.

13 Claims, 2 Drawing Sheets

IMPACT PAD FOR LADLES

BACKGROUND OF THE INVENTION

This invention relates to high temperature refractories and more particularly to individual refractory geometries and composite assemblies of such refractories.

As is known to those skilled in the art, the handling of high temperature liquids, such as molten steel, requires special materials and techniques. The melting temperature of steel approaches 2,900° Fahrenheit, a level above that which most containment materials can withstand. Moreover, molten steel usually includes slag that can be fluid and corrosive which adds to the complexity and difficulty of efficient handling.

Ladles for handling such high temperature liquids typically have been constructed of steel outer shells lined with refractory brick that can withstand the extremely harsh conditions to which they are exposed. However, such brick wear and from time to time must be repaired or replaced. In addition, when high temperature liquids are poured into such ladles the impact forces (as, for example by a tap stream of molten steel) tend to markedly increase erosion in the lower sidewall and bottom regions of the ladle.

In the interest of efficient geometries, ladles for high temperature liquids typically are essentially circular or obround in cross section, thus leading to the need for corresponding brick shapes. Heretofore it has been customary to use what has become known in the industry as semi-universal ladle brick (SULB). These brick are described in U.S. Pat. Nos. 2,818,248 and 3,140,333. They are shaped so that they conform to the change in diameter of the ladle interior while interlocking with each other so as to facilitate retention in place.

In order to balance lining wear in steel ladles, the brick in the area of steel stream impact need to be thicker than the remainder of the lining. These thicker brick are generally referred to as the "impact pad". Simply installing a thicker lining throughout the ladle would not be cost effective and would prohibitively reduce ladle capacity. Since the bottom of the ladle is lined with standard rectangular brick which are laid in a flat plan, installing an impact pad of greater thickness here is not a problem. However, when an impact pad is added to the sidewall, the semi-universal brick must be cut square on both sides of the pad, thus adding undesired labor time, cost, and complexity.

It has also been proposed to include dual tapers in the foregoing refractories in order to compensate for the changing diameter of the ladle casing that occurs in many ladles. Such tapers are set forth in U.S. Pat. No. 3,346,248.

BRIEF SUMMARY OF THE INVENTION

The improved refractory according to the instant invention overcome the problems of the prior art and includes brick having a rear portion having certain characteristics of the aforementioned semi-universal brick, together with an integral front portion having a generally rectangular geometry, preferably key or wedge-shaped, thus providing in one unitary refractory the qualities of both the above-described semi-universal brick and a thicker protective impact pad for sidewall application.

OBJECTS AND FEATURES OF THE INVENTION

It is one general object of the invention to improve the installation of high temperature ladle refractories.

It is yet another object of the invention to balance the refractory lining wear in a ladle by providing an impact pad in the sidewall.

It is another object of the invention to decrease ladle down time and costs associated with excessive wear of the impact zone.

Accordingly, in accordance with one feature of the invention, a refractory brick is shaped to include a rear portion having a plurality of curved surfaces adapted for interlocking with correspondingly curved surfaces of adjacent brick while additionally including extending linear portions adapted for juxtaposed contact with adjacent brick, thereby providing both for locking together of the bricks and for presenting to an impacting stream of liquid iron or steel a thicker impact pad.

In accordance with another feature of the invention, a plurality of such refractories is assembled in a composite for lining the interior of a conventional ladle, thereby providing a greater lining thickness to impacting liquid streams.

These and other objects and features of the invention will be apparent from the following description, by way of example of a preferred embodiment, with reference to the drawing.

DESCRIPTION OF A PREFERRED EMBODIMENT

Definition

Before proceeding with a detailed description, note should be taken of the following definition for the term "slightly curved" as employed in this description and the appended claims. By "slightly curved" is meant a containment vessel inner curvature as present in the inner surface thereof against which the refractory bricks hereof are to be installed.

Figure 1:
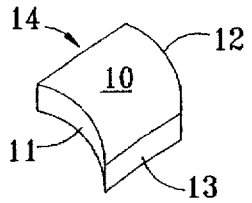
FIG. 1 (PRIOR ART)
FIG. 1 is a perspective view of a semi-universal refractory brick in accordance with the prior art.
Figure 2:
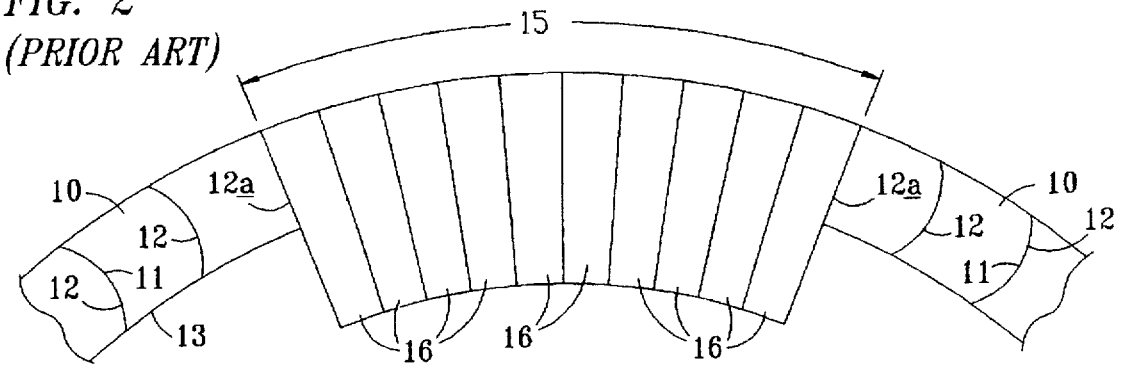
FIG. 2 (PRIOR ART)
FIG. 2 is a view depicting a typical array of refractory brick according to the prior art.

Now turning to the drawings, FIG. 1 illustrates a typical semi-universal refractory brick 10 according to the prior art. Such refractory is generally brick-shaped and has a generally concave surface 11 that is curved to mate with convex surface 12 of another brick as shown in FIG. 2. Thus, the radius of curvature of side face 11 is identical to the radius of curvature of side face 12. Refractory brick 10 has a front surface 13 and a rear surface 14 which, although shown as essentially linear in FIG. 1 may be slightly curved to match the radius of curvature of the inner walls of a conventional ladle. For additional description of brick 10, reference is made to U.S. Pat. Nos. 3,140,333 and 2,818,248.

Typically, refractories such as refractory brick 10 extend entirely around the inner surface of the receptacle in which they are positioned except for a region generally represented by arc 15 (FIG. 2) that defines the region in which a tap stream impacts the inner surface when introduced into the ladle. There, so as to provide protection against excessive erosion, a plurality of brick 16 to provide for a thicker lining are disposed instead of the semi-universal bricks 10. However, in order to set such bricks in place, it has been necessary to cut essentially square the ends 12*a* of the two otherwise universal bricks 10 that are positioned next to bricks 16, thus entailing additional time and expense. Moreover, because the adjacent contacting surfaces of bricks 16 are essentially planar, they lack the self-locking, mating curvatures represented by surfaces 11 and 12 of bricks 10. Further, great care must be taken in cutting and installing these bricks to avoid open joints.

As mentioned above, FIG. 3 is a perspective view of the improved refractory brick according to the invention. There is shown a composite refractory brick 26 having a rear portion 18 lying laterally between concave surface 19 and convex surface 20. As shown, such portion extends for distance "a" from the rear surface 21 to points 22*a* and 22*b* which define the portion 22 which lies between essentially planar surface 23 and essentially planar surface 24. At the front of this shape there is shown essentially planar surface 25.

It will be observed that the longitudinal dimension of rear surface 21 is shown as 8¼ inches, a dimension which has become an industry standard. However, such dimension could readily be changed without departing from the spirit and scope of the invention.

Dimensions "b" and "c" preferably will vary depending upon the diameter of the containment vessel in which the improved refractories 26 are installed. Thus, the ratio of dimension "c" to the width of surface 21 should preferably be proportional to the ratio of the radius r1 to r2 (FIG. 4) in order to compensate for the different radii of curvature. It should also be understood that the surfaces 21 and 25 may be slightly curved as set forth in the foregoing definition. As is evident from reference to the drawing, dimension "d" is the vertical dimension of the brick.

Figure 3:
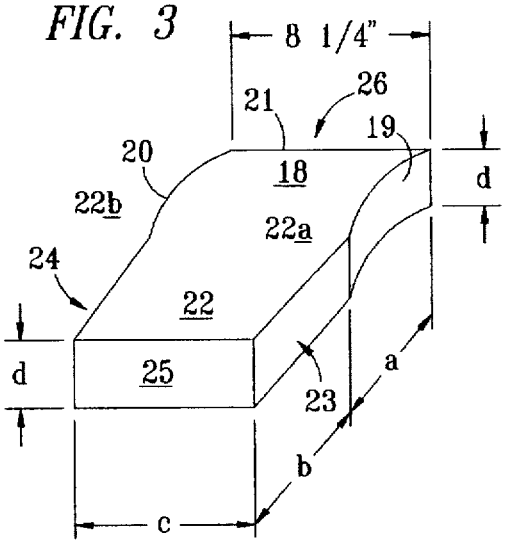
FIG. 3 is a perspective view of the improved refractory brick according to the invention.
Figure 4:
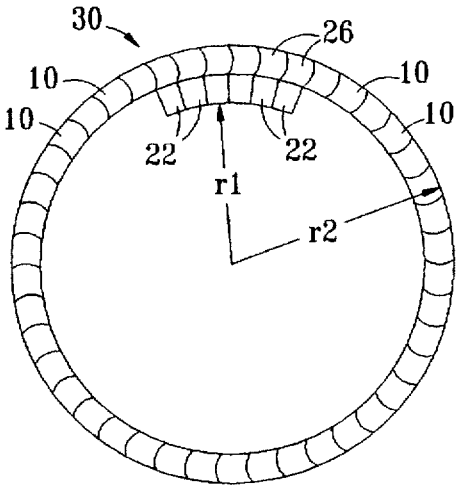
FIG. 4 is a top view showing an array of refractory brick disposed in accordance with the invention.

FIG. 4 is a top view (not in proportion) of an array of refractory bricks disposed within a typical steel ladle (not shown) in accordance with the invention. This figure shows a plurality of the aforementioned semi-universal refractory brick 10 which are positioned around the annular configuration 30. The size of the bricks, for illustration purposes, are much larger than in practice, since ladles have diameters of 20 feet or more and the bricks are about a foot in length. However, in an arc corresponding to arc 15 of FIG. 2, there are installed a plurality of the improved refractory bricks 26 which are locked into place by the mating adjacent arcuate portions 19 and 20 (FIG. 3) and which do not require modification by square cutting of adjacent surfaces such as those of faces 12*a* in FIG. 2. Moreover, the extending portions 22 provide a contact surface positioned to receive and provide protection against the tap stream which in the absence of special provisions, is excessively abrasive and injurious to the receiving ladle.

Figure 5:
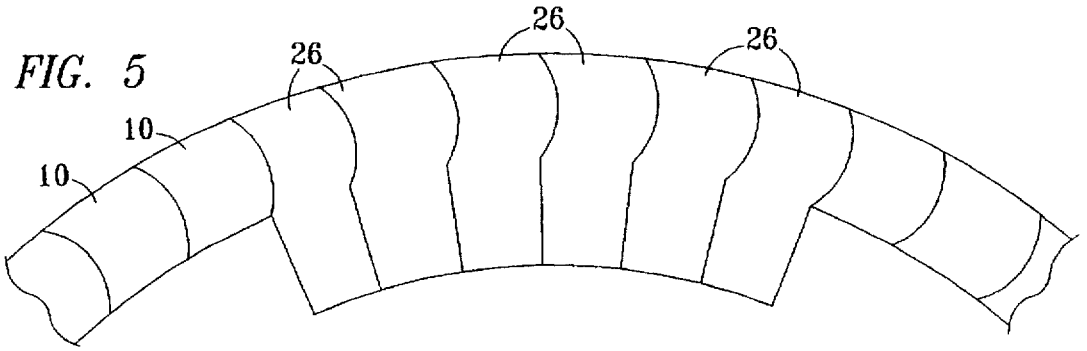
FIG. 5 is an enlarged view of the upper part of FIG. 4 and depicting in greater detail the impact resistant extensions in the regions impacted by molten iron or steel tap streams.

FIG. 5 shows in greater detail a section similar to that of the upper part of FIG. 4. There are, it will be seen, a plurality of the semi-universal refractory bricks 10 together with a plurality of interlocking refractory bricks 26 that embody the principles of the invention. It should be evident that refractory bricks 10 and 26 interlock and that their cooperative combination eliminate the need for squaring ends of the selected refractory bricks 10. In addition, the inclusion of the above-described concave and convex surfaces in refractory bricks 26 lock them into place, whereas the corresponding surfaces of refractory bricks 16 (FIG. 2) do not provide such an advantage.

Figure 6A:
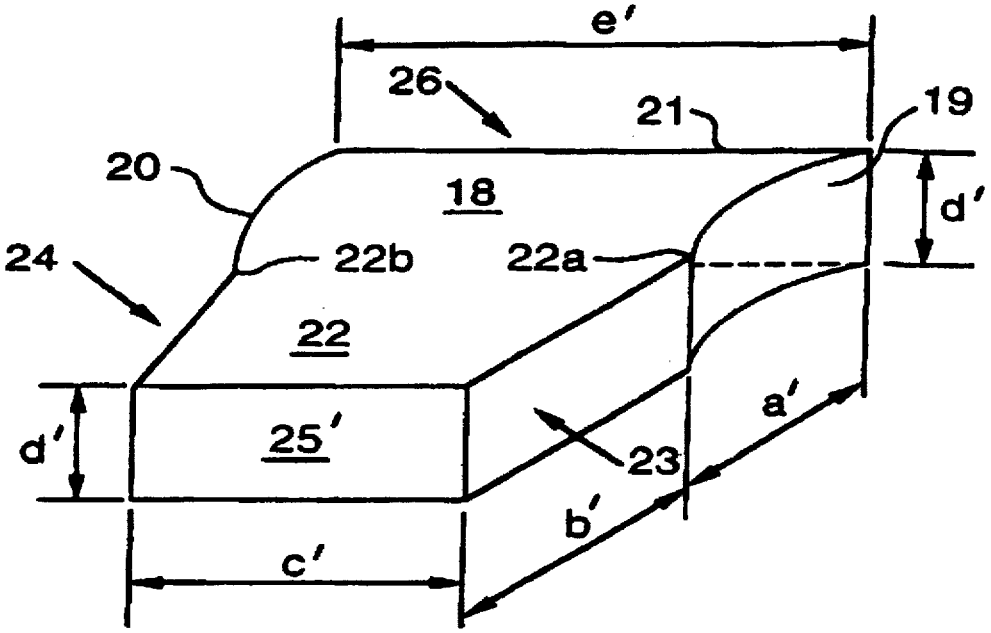
FIG. 6 is a perspective view similar to that of FIG. 3 but depicting two of the improved refractories with different front width dimensions.
Figure 6B:
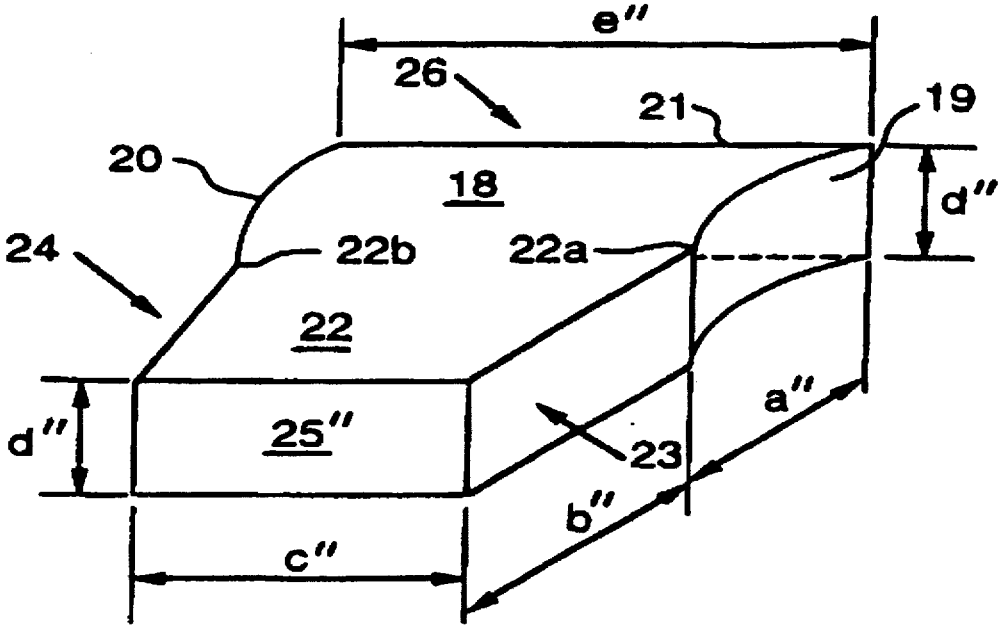

Now turning to FIG. 6, there will be seen two of the refractories of FIG. 3 with first and second front surfaces 25' and 25" which have first and second widths c' and c". These widths are provided so that the improved refractories can be more readily used in combination to fit ladles of varying diameters. The rear dimensions are illustrated by symbols e' and e" in keeping with the use of corresponding prime symbols for designating the front surfaces and dimensions 25', 25", c' and c".

Although the inventions hereof have been described by way of a preferred embodiment, it will be evident that other adaptations and modifications may be employed without departing from the spirit and scope thereof.

The terms and expressions employed herein have been used as terms of description and not of limitation; and, thus, there is no intent of excluding equivalents, but on the contrary it is intended to cover any and all equivalents that may be employed without departing from the spirit and scope of the invention.

What is claimed is:

1. An improved refractory brick comprising:

(a) a base portion including:

(i) a rear surface having a center and a first width across said rear surface, said first width being defined by rear portions of a side curved concave surface and an opposing side curved convex surface, the curvature of said concave surface being in mating geometrical relationship to said curved convex surface;

(ii) a first essentially uniform vertical thickness, said first thickness being defined by an upper essentially planar surface and a lower essentially planar surface parallel to said upper surface; and (b) a semi-rectangular key or truncated wedge-shaped projection of thickness essentially equal to said first thickness extending from said base portion at a location opposite to that of said rear surfacer, said semi-rectangular projection having a front surface with a center, and wherein a centerline of said front surface and a center line of said rear surface are in axial alignment.

2. The improved refractory brick of claim 1 in which thickness of said semi-rectangular projection is defined by coplanar contiguous extensions of said upper essentially planar surface and said lower essentially planar surface.

3. The improved refractory brick of claim 2 in which said rear surface is slightly curved.

4. The improved refractory brick of claim 2 in which said rear surface is planar.

5. An improved refractory brick according to claim 4 in which said semi-rectangular projection includes a front surface smaller than said rear surface.

6. The improved refractory brick of claim 2 in which said front surface is substantially parallel to said rear surface.

7. An improved refractory brick according to claim 6 in which said semi-rectangular projection is elongated in a direction essentially perpendicular to the plane of said rear surface.

8. The improved refractory brick of claim 2 in which said semi-rectangular projection includes two planar sides.

9. In combination, a first and second improved refractory brick each according to claim 2 in which said semi-rectangular projection of said first brick includes a front surface of a first width and said semi-rectangular projection of said second brick includes a front surface of a second width such that said first and said second bricks can be used in said combination to fit ladles of varying diameters.

10. An improved refractory liner for containment of high temperature fluids comprising, in combination, an assembly of improved refractory bricks according to claim 1 locked together into an arcuate configuration.

11. For an arcuate high temperature containment vessel, an improved refractory brick comprising:

(a) a base portion including:

(i) a slightly curved rear surface having a center and a first width across said rear surface, said first width being defined by rear portions of a side curved concave surface and an opposing side curved convex surface, the curvature of said concave surface being in mating geometrical relationship to said curved convex surface;

(ii) a first essentially uniform vertical thickness, said first thickness being defined by an upper essentially planar surface and a lower essentially planar surface parallel to said upper surface; and (b) a semi-rectangular key or truncated wedge-shaped projection of thickness essentially equal to said first thickness extending from said base portion at a location opposite to that of said rear surface, said semi-rectangular projection having:

(i) thickness defined by coplanar continuous extensions of said upper essentially planar surface and said lower essentially planar surface; and (ii) a front surface with a center; and wherein a centerline of said front surface and a center line of said rear surface are in axial alignment.

12. An improved refractory brick according to claim 11 in which said rear surface has a first radius of curvature and in which said semi-rectangular projection includes an arcuate front surface with a second radius of curvature, the ratio of said first radius of curvature to said second radius of curvature adapted to be defined by the internal radius of said arcuate containment vessel.

13. An improved refractory brick according to claim 11 in which said rear surface has a first radius of curvature and in which said semi-rectangular projection includes an arcuate front surface with a second radius of curvature, the ratio of said radii of curvature adapted to be substantially equal to a ratio of radius of said containment vessel.

* * * * *